US008567994B2

(12) United States Patent
Gang et al.

(10) Patent No.: US 8,567,994 B2
(45) Date of Patent: Oct. 29, 2013

(54) STREET LAMP USING LEDS

(75) Inventors: Ju Seong Gang, Ansan (KR); Chan Hun Gang, Ansan (KR)

(73) Assignee: Sung Hyun High-Tech Co., Ltd., Hwaseong (KR)

( * ) Notice: Subject to any disclaimer, the term of this patent is extended or adjusted under 35 U.S.C. 154(b) by 463 days.

(21) Appl. No.: 12/994,845

(22) PCT Filed: May 28, 2009

(86) PCT No.: PCT/KR2009/002854

§ 371 (c)(1),
(2), (4) Date: Nov. 26, 2010

(87) PCT Pub. No.: WO2009/145580

PCT Pub. Date: Dec. 3, 2009

(65) Prior Publication Data

US 2011/0075424 A1 Mar. 31, 2011

(30) Foreign Application Priority Data

May 29, 2008 (KR) ..... 10-2008-0050519
Dec. 2, 2008 (KR) ..... 10-2008-0120873

(51) Int. Cl.
*F21V 17/02* (2006.01)

(52) U.S. Cl.
USPC . 362/282; 362/294; 362/311.01; 362/311.02; 362/323; 362/373; 362/277; 362/296.01; 362/317; 362/319

(58) Field of Classification Search
USPC ..... 362/282, 294, 311.01, 311.02, 323, 362/373, 277, 296.01, 317, 319
See application file for complete search history.

(56) References Cited

U.S. PATENT DOCUMENTS

| | | | | | |
|---|---|---|---|---|---|
| 1,208,914 | A | * | 12/1916 | Clary | 362/319 |
| 3,803,400 | A | * | 4/1974 | Ozawa | 362/372 |
| 4,429,351 | A | * | 1/1984 | Petzl et al. | 362/187 |
| 5,404,297 | A | * | 4/1995 | Birk et al. | 362/421 |
| 5,584,574 | A | * | 12/1996 | Haddad | 362/359 |
| 6,986,593 | B2 | * | 1/2006 | Rhoads et al. | 362/308 |
| 7,198,398 | B2 | * | 4/2007 | Buelow et al. | 362/581 |

(Continued)

FOREIGN PATENT DOCUMENTS

| | | | |
|---|---|---|---|
| JP | 2004-311188 | A | 11/2004 |
| KR | 20-0266609 | Y1 | 2/2002 |

(Continued)

OTHER PUBLICATIONS

International Search Report for PCT/KR2009/002854 filed May 28, 2009.

(Continued)

*Primary Examiner* — Mary McManmon

(57) ABSTRACT

The present invention relates to a street lamp which uses LEDs as a light source and has a freely adjustable lighting direction and an adjustable lighting range. The street lamp of the present invention includes a housing 1; LEDs 10 arranged in the housing 1; heat radiation fins 20 formed on an upper surface of the housing 1; a lighting direction adjuster 30 arranged on the bottom surfaces of the heat radiation fins 30 in the housing 1; and a lens case 40 attached to an upper surface of the lighting direction adjuster 30 and equipped with a lens moving means for positioning a lens 49 arranged in the lens case wherein the lighting direction adjuster 30 includes a spherical rotating body 32; a receiving body 34 having a groove 35 for accommodating the spherical rotating body 34; and a cover plate 36 arranged on the rotating body 32.

8 Claims, 12 Drawing Sheets

(56) References Cited

U.S. PATENT DOCUMENTS

| | | | | |
|---|---|---|---|---|
| 7,473,007 | B1 * | 1/2009 | Wang | 362/187 |
| 7,494,252 | B1 * | 2/2009 | Thornton et al. | 362/294 |
| 7,896,524 | B2 * | 3/2011 | Yoneda et al. | 362/282 |
| 8,016,451 | B2 * | 9/2011 | Householder et al. | 362/188 |
| 8,047,685 | B2 * | 11/2011 | Wu et al. | 362/277 |
| 2005/0201100 | A1 * | 9/2005 | Cassarly et al. | 362/317 |
| 2006/0016448 | A1 * | 1/2006 | Ho | 126/698 |
| 2007/0189010 | A1 * | 8/2007 | Arai | 362/257 |
| 2009/0185376 | A1 * | 7/2009 | Yu | 362/253 |
| 2013/0188363 | A1 * | 7/2013 | Matsuura | 362/311.01 |

FOREIGN PATENT DOCUMENTS

| | | | |
|---|---|---|---|
| KR | 10-2004-0037523 | A | 5/2004 |
| KR | 20-0389249 | Y1 | 7/2005 |
| KR | 10-2007-0097679 | A | 10/2007 |
| KR | 20-0437242 | Y1 | 11/2007 |
| KR | 10-2008-0040086 | A | 5/2008 |

OTHER PUBLICATIONS

Written Opinion of the International Searching Authority for PCT/KR2009/002854 filed May 28, 2009.

* cited by examiner

STREET LAMP USING LEDS

CROSS-REFERENCE(S) TO RELATED APPLICATIONS

The present invention claims priority of Korean Patent Application No. 10-2008-0050519, filed on May 28, 2008, and priority of Korean Patent Application No. 10-2008-0120873, filed on Dec. 2, 2008, which are incorporated herein by reference.

BACKGROUND OF THE INVENTION

1. Field of the Invention

The present invention relates to a street lamp using LEDs, and more particularly, to a street lamp using LEDs, which can freely adjust a lighting direction and a lighting range.

2. Description of Related Art

Generally, in order to provide illumination to pedestrians and car drivers at night, street lamps or park lamps are disposed around a road or a footpath of a park so as to be spaced apart from each other in regular intervals, and tower poles are mainly disposed at a square.

As shown in FIG. 1, the street lamp, the park lamp or the tower pole functions to provide illumination to the pedestrians at night time using light emitted from a sodium vapor lamp or an incandescent lamp.

Recently, there is a drift toward increasing use of a street lamp which uses LEDs as a light source.

However, in a conventional street lamp, since it is difficult to adjust a lighting direction and a lighting range thereof, the street ramp continuously illuminates plants therearound as well as sidewalks for pedestrians, and thus it has great influences on the ecological environment therearound like flowering time of the plants.

SUMMARY OF THE INVENTION

An embodiment of the present invention is directed to providing a street lamp using LEDs, which can easily and efficiently adjust a lighting direction and a lighting range of light emitted from the LEDs.

Another embodiment of the present invention is directed to providing a street lamp using LEDs, which can illuminate only a desired place such as a sidewalk and a footpath, thereby minimizing influences on the plants around the sidewalk or the footpath.

To achieve the object of the present invention, the present invention provides a street lamp using LEDs as a light source, which includes a lighting direction adjuster for adjusting a direction of light emitted from the LEDs, and a lens moving means disposed at an upper side of a lens for diffusing the light, thereby freely adjusting the lighting direction and the lighting range.

Further, the present invention provides a street lamp using LEDs, in which a reflecting plate is disposed around the lens so as to prevent the light from being irradiated to an undesired place.

DETAILED DESCRIPTION OF MAIN ELEMENTS

| | |
|---|---|
| 1: housing | 10: LED |
| 20: heat radiation fin | |
| 30: lighting direction adjuster | |
| 32: rotating body | 33: upper surface |
| 34: receiving body | 35: groove |
| 36: cover plate | |
| 37: lower protruding portion | |
| 38: upper protruding portion | 40: lens case |
| 42: lower lens case | 44: upper lens case |
| 44A: heat radiation hole | 45: step |
| 46, 48: flange | 49: lens |
| 49A: elliptical lens | 50: hollow portion |
| 51: groove | |
| 52: lens fixing plate | 61, 62: screw thread |
| 63: slot | 66: supporting protrusion |
| 67: colored acrylic plate | 70: reflecting plate |

DESCRIPTION OF SPECIFIC EMBODIMENTS

The advantages, features and aspects of the invention will become apparent from the following description of the embodiments with reference to the accompanying drawings, which is set forth hereinafter.

The present invention is to provide a street lamp using LEDs, which can easily and efficiently adjust a lighting direction and a lighting range of light emitted from the LEDs.

Figure 1:
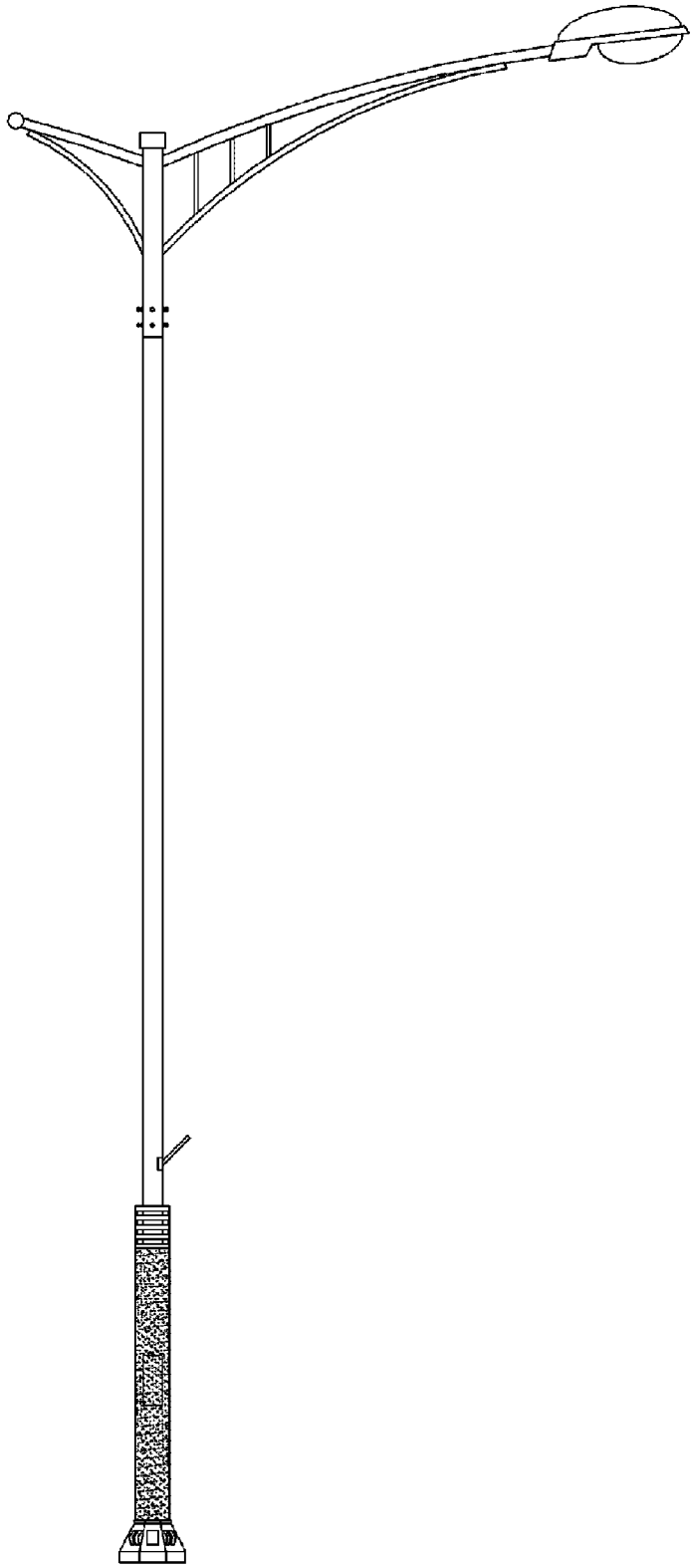
FIG. 1 is a perspective view of a conventional street lamp.
Figure 2:
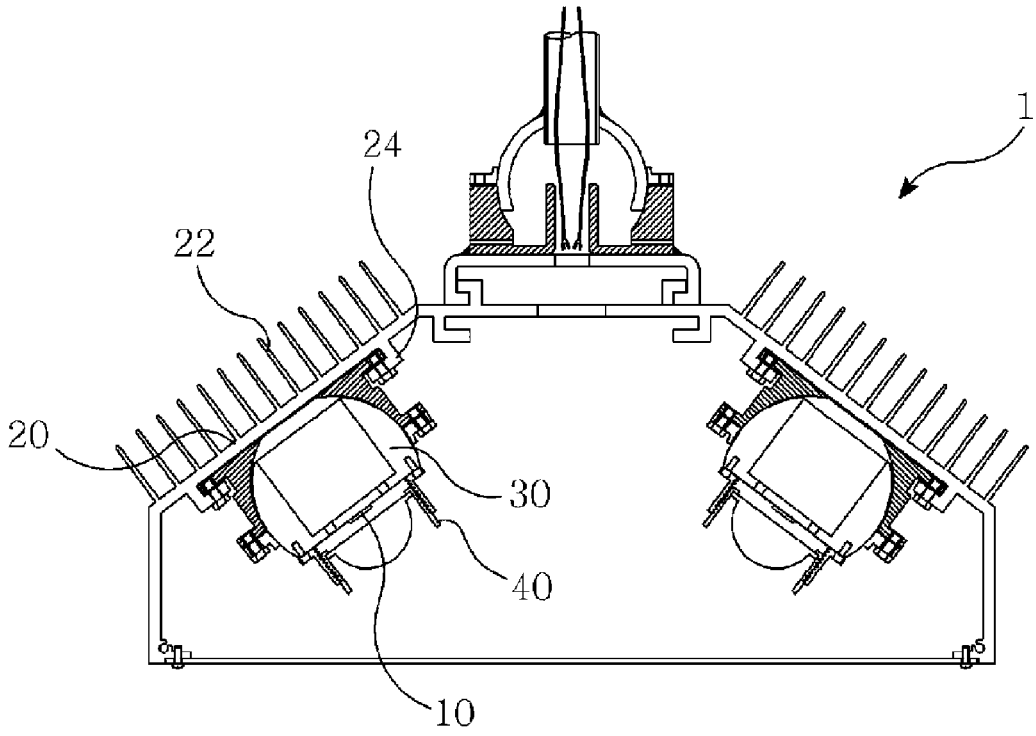
FIG. 2 is a cross-sectional view of a street lamp using LEDs according to the present invention.

To this end, as shown in FIG. 2, street lamp using LEDs according to the present invention includes a housing 1; LED 10 disposed in the housing 1; a heat radiation fin 20 formed on an upper surface of the housing 1; a lighting direction adjuster 30 disposed on a bottom surface of the heat radiation fin 20 in the housing 1; and a lens case 40 attached to an upper surface of the lighting direction adjuster 30 and equipped with a lens moving means for positioning a lens 49 disposed in the lens case 40, wherein the lighting direction adjuster 30 includes a spherical rotating body 32; a receiving body 34 having a groove for receiving the spherical rotating body 34; and a cover plate 36 disposed on the rotating body 32.

The housing 1 is a lampshade in which the LED is disposed. The LED is disposed inside the housing 1 and the heat radiation fin 20 is disposed outside the housing 1.

In order to dispose the LED in the housing 1, a pair of brackets 24 for attaching the lighting direction adjuster 30 is formed on a bottom surface of the heat radiation fin 20 so that the brackets 24 are spaced part from each other in a distance corresponding to a width of the lighting direction adjuster 30.

In case that the heat radiation fin 20 is formed to be vertical to the housing 1, rainwater or foreign substances may be gathered between the heat radiation fins. In order to prevent the problem, it is preferable that the heat radiation fin 20 is formed to be horizontal with the housing 1.

Meanwhile, the lighting direction adjuster 30 is coupled with the lens case 40 so as to adjust a lighting direction and a lighting range of the LED 10. Hereinafter, the construction of the lighting direction adjuster 30 and the lens case 40 will be described according to embodiments.

First Embodiment

Figure 4:
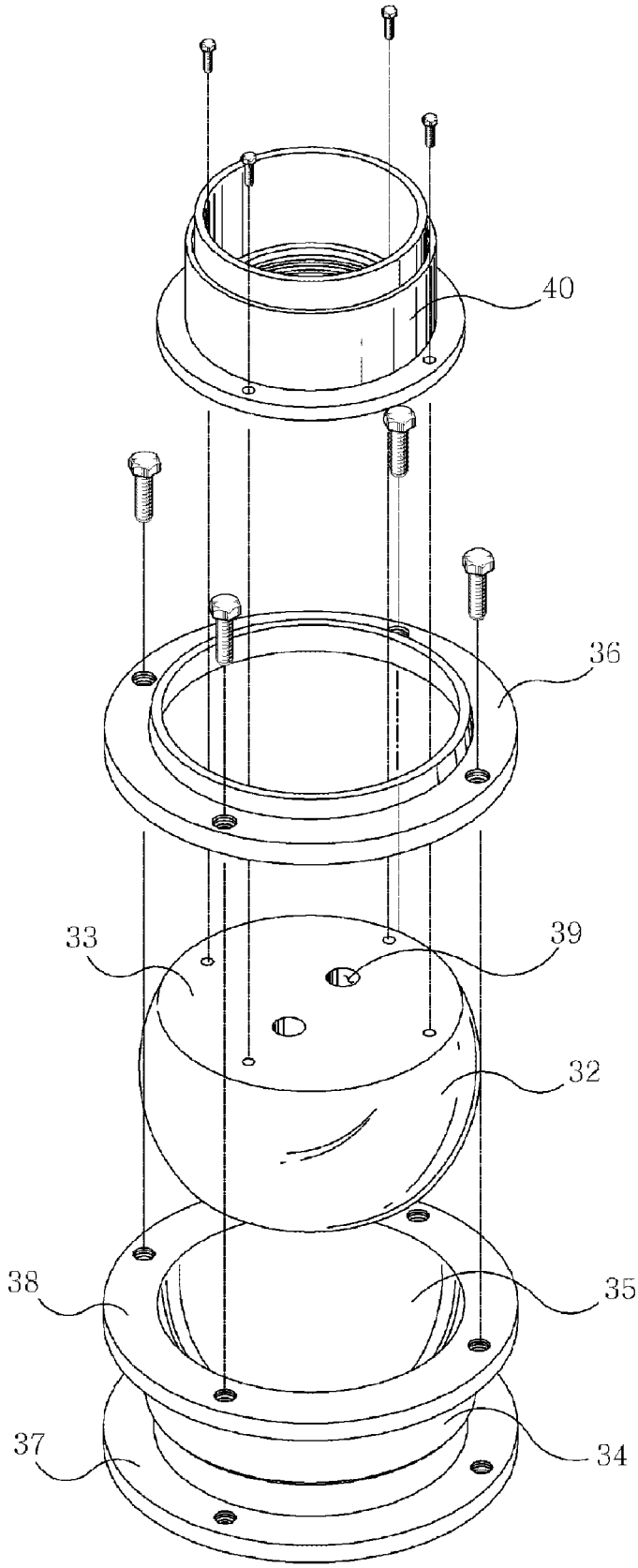
FIG. 4 is an exploded perspective view of FIG. 3.

As shown in FIG. 4, the lighting direction adjuster 30 includes the spherical rotating body 32 and the receiving body 34 having the groove for receiving the spherical rotating body 34.

The receiving body 34 is formed with the spherical groove 35 for receiving the spherical rotating body 34. Upper and lower protruding portions 38 and 37 are formed at edge parts of upper and lower ends of the receiving body 34. The lower protruding portion 37 is fixed to the bracket 24 in the housing 1 by a bolt, and the upper protruding portion 38 is fixed to the cover plate 36 by a bolt.

The cover plate 36 functions to prevent the spherical rotating body 34 received in the groove 35 of the receiving body 34 from being separated from the groove 35. The cover plate 36 has an opening corresponding to an external shape of the spherical rotating body 32 so that the spherical rotating body 32 can be freely rotated. A Bolt hole is formed at an edge portion of the cover plate 36 so that the cover plate 36 is coupled with the receiving body 34 by a bolt. Therefore, if the lighting direction is decided, the lighting direction is fixed by fastening the bolt.

Figure 3:
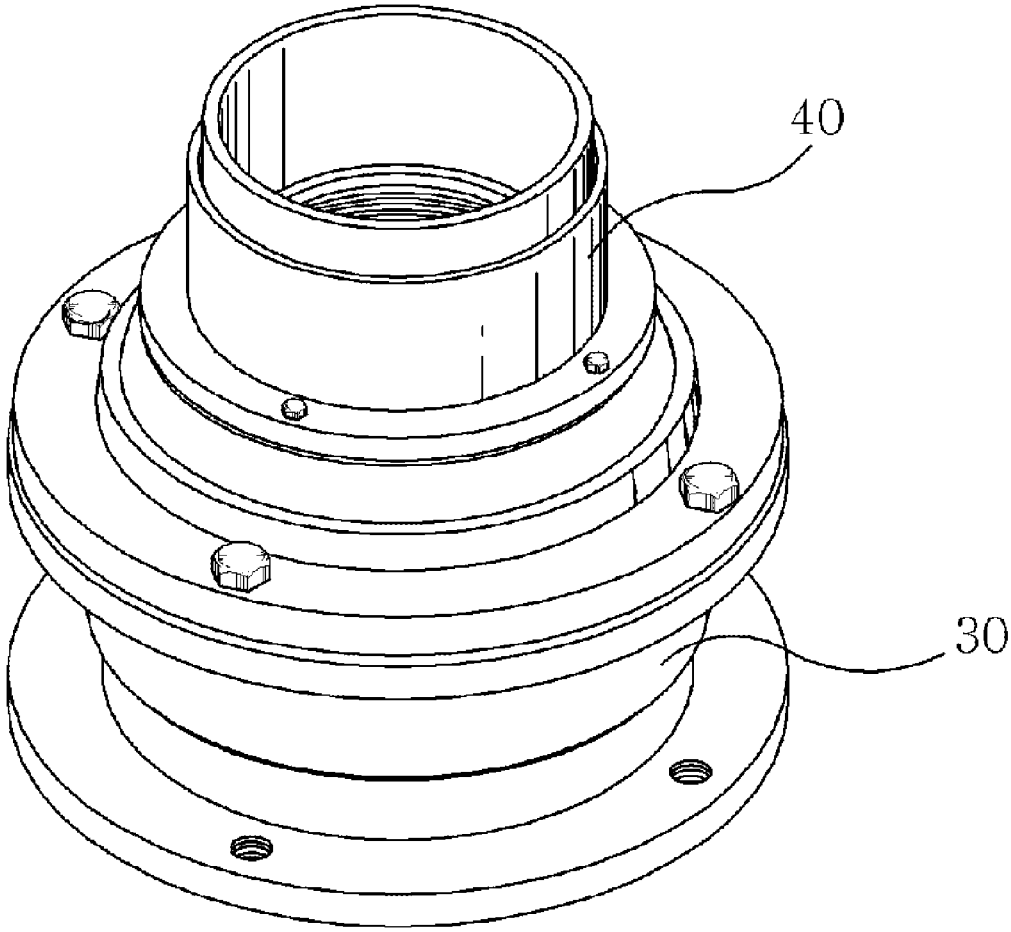
FIG. 3 is a perspective view showing a state that a lighting direction adjuster and a lens moving means of the street lamp using LEDs are assembled according to a first embodiment of the present invention.

As shown in FIGS. 2 and 3, a side portion of the spherical rotating body 32 is formed into a spherical shape, an upper portion thereof is formed into a flat surface, and a lower portion thereof is opened.

Further, a bolt hole is formed at an edge portion of an upper surface 33 of the spherical rotating body 32 in order to couple the lens case 40, and a power line insertion hole 39 is formed at a radially internal side of the upper surface 33 so as to pass through the upper surface 33, such that a power line is inserted into and passed through the power line insertion hole 39.

The LED 10 is attached on the upper surface 33 of the spherical rotating body 32. And at an upper side of the LED 10, the lens case 40 having the lens 49 is fixed to the upper surface 33 of the spherical rotating body 32.

Figure 5:
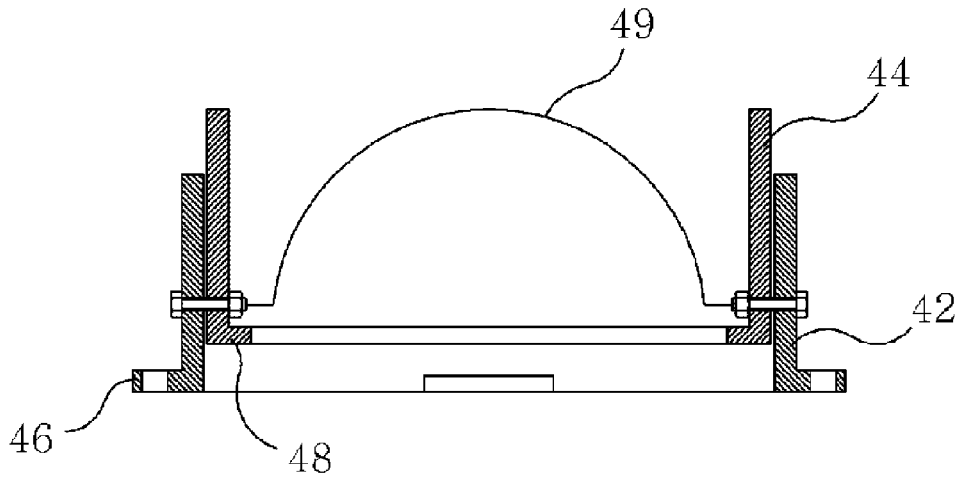
FIG. 5 is a cross-sectional view of a lens case of the street lamp using LEDs according to the first embodiment of the present invention.

As shown in FIG. 5, the lens case 40 fixed to the upper surface 33 of the spherical rotating body 32 includes a lower lens case 42 and an upper lens case 44. The upper lens case 44 is inserted into the lower lens case 42.

The lower lens case 42 is formed into a cylindrical shape of which upper and lower sides are opened. A flange 46 is formed at a lower end of the lower lens case 42 so as to be radially protruded to an outside of the lower lens case 42. The flange 46 is formed with a bolt hole by which the lens case 40 can be fixed to the upper surface 33 of the spherical rotating body 32 using the bolt.

The upper lens case 44 inserted into the lower lens case 42 is also formed into a cylindrical shape of which upper and lower sides are opened. A flange 48 is formed at a lower end of the upper lens case 44 so as to be radially protruded to an inside of the upper lens case 44, and the lens 49 is disposed on the flange 48.

The lens case 40 of the present invention is provided with a lens moving means for positioning the lens 49 in various ways. By using the lens moving means, it is possible to adjust the lighting range of the light emitted from the LED 10.

Figure 6:
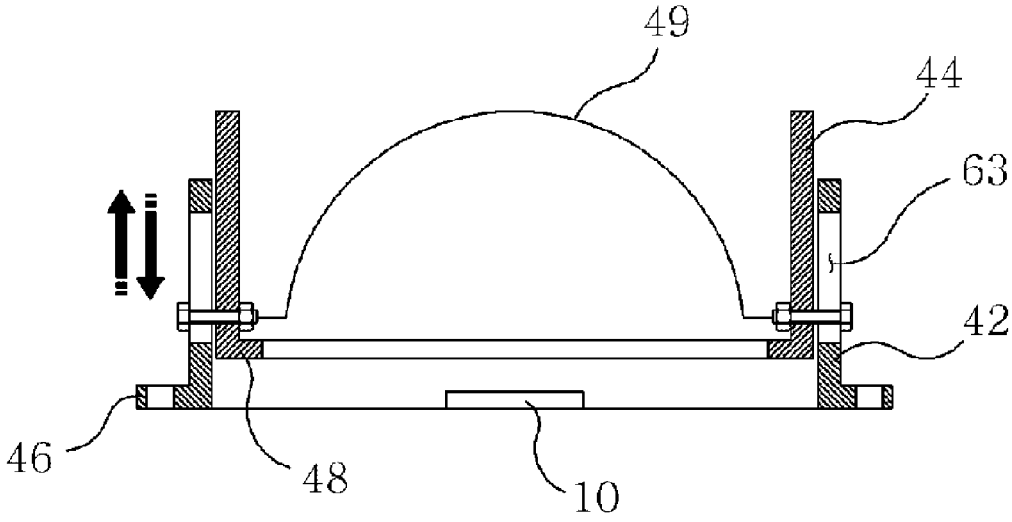
FIGS. 6, 7 and 8 are cross-sectional views showing various examples of the lens moving means of the street lamp using LEDs according to the first embodiment of the present invention.

As a first example of the lens moving means, as shown in FIG. 6, two slots 63 opposed to each other are formed in a length direction of the lower lens case 42, and two bolt holes opposed to each other are formed at the upper lens case 44 so as to adjust positions of bolts to be fastened in the slots 63, thereby adjusting the lighting range.

Figure 7:
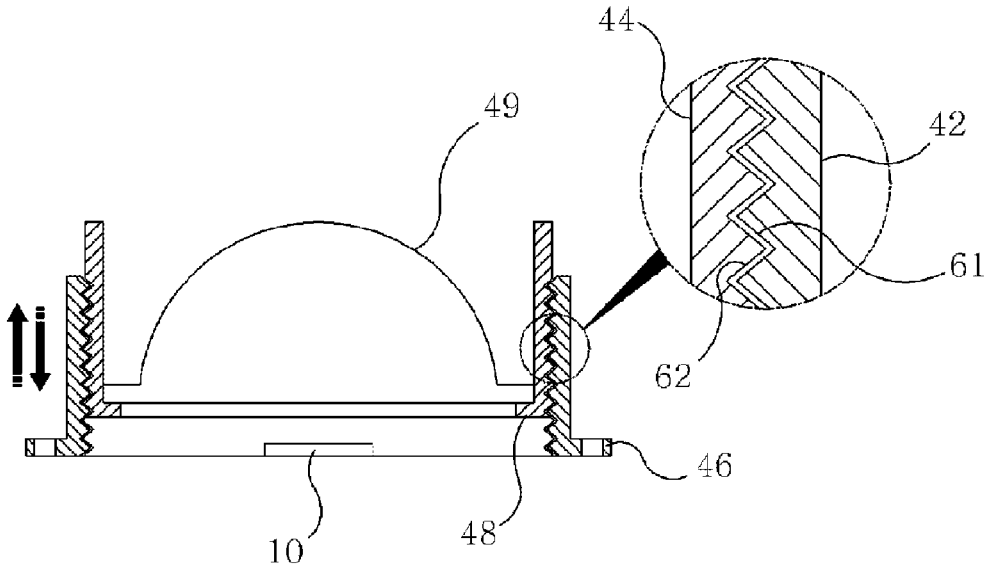

As a second example of the lens moving means, as shown in FIG. 7, a screw thread 61 is circumferentially formed on an inner surface of the lower lens case 42, and also a screw thread 62 is circumferentially formed on an outer surface of the upper lens case 44. If the upper lens 44 engaged with the lower lens case 42 is rotated, the upper lens 44 is moved forward and backward, and thus the lens 49 is also moved forward and backward, thereby adjusting the lighting range of the light emitted from the LED 10.

Figure 8:
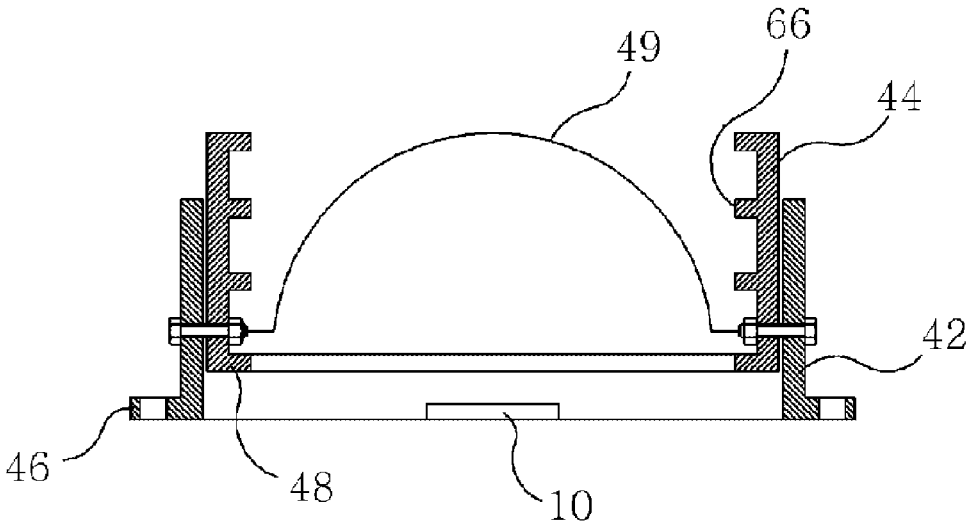

As a third example of the lens moving means, as shown in FIG. 8, two bolt holes are formed at each side surface of the upper and lower lens cases 44 and 42, and the upper and lower lens cases 44 and 42 are coupled to each other via the bolt holes by a bolt. A plurality of supporting protrusions 66 are formed at an inner surface of the upper lens case 44 so as to be spaced apart at regular intervals in a length direction of the upper lens case 44, and the lens 49 is disposed at one of the supporting protrusions 66. When the position of the lens 49 is changed, the lens 49 is separated from the supporting protrusion 66 and then disposed at other supporting protrusion 66.

The supporting protrusions 66 are made of a flexible material in order to freely change the position of the lens 49.

Figure 9:
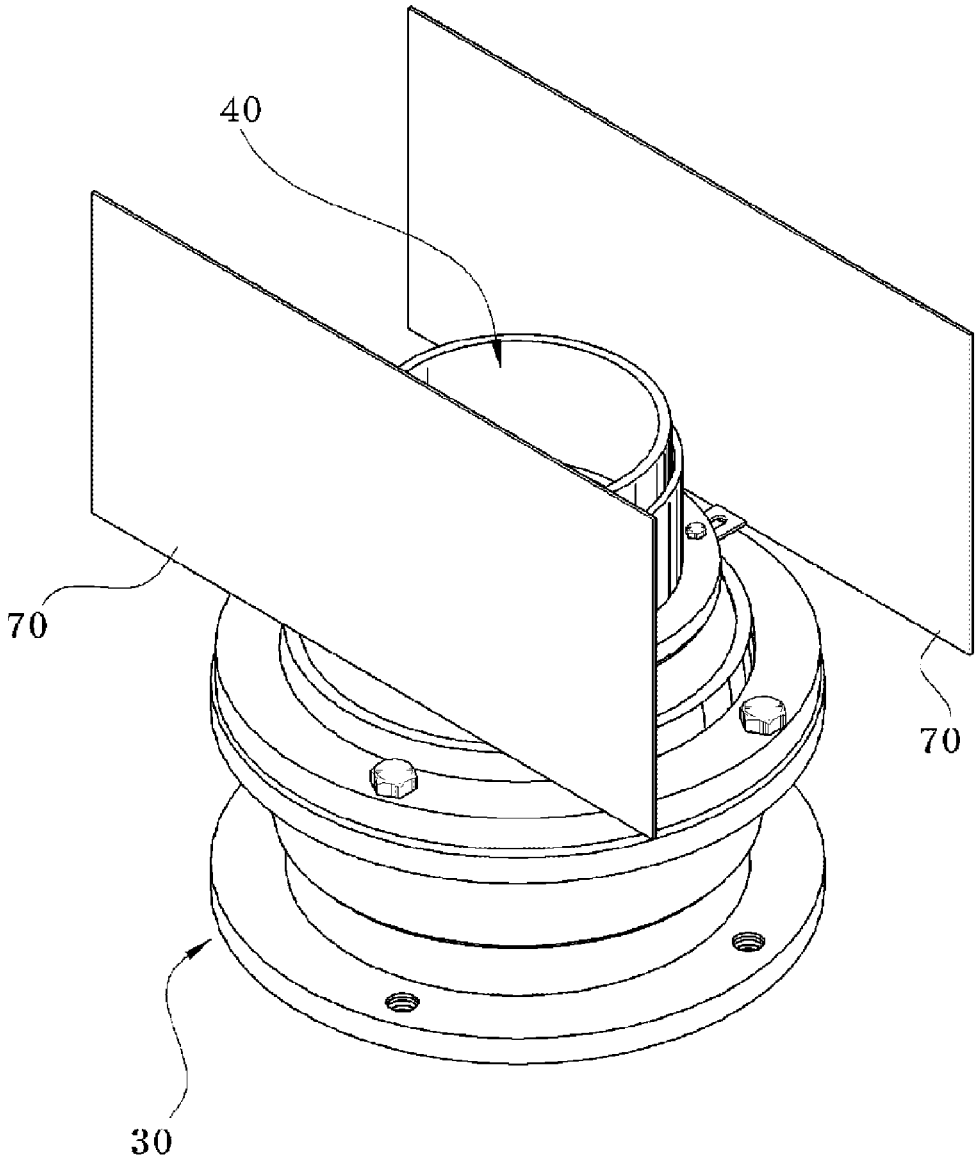
FIG. 9 is a plan view showing an attached state of a reflecting plate according to the first embodiment of the present invention.

As shown in FIG. 9, a straight reflecting plate 70 may be further provided at the side of the lens case 40 in order to illuminate the light emitted from the ELD 10 onto a desired place.

The reflecting plate 70 is attached to the side of the lens case 40. The side of the lens case 40 to which the reflecting plate 70 is attached may be changed according to the number of light sources disposed in the street lamp or the installation condition. That is, in case that the reflecting plate 40 is disposed at both sides of the lens case 40, the reflecting plates 40 are arranged at the both sides of the lens case 40 so as to be opposite to each other, and the reflecting plates 40 are fixed to the flange 46 of the lower lens case 42 by bolts.

Second Embodiment

Figure 10:
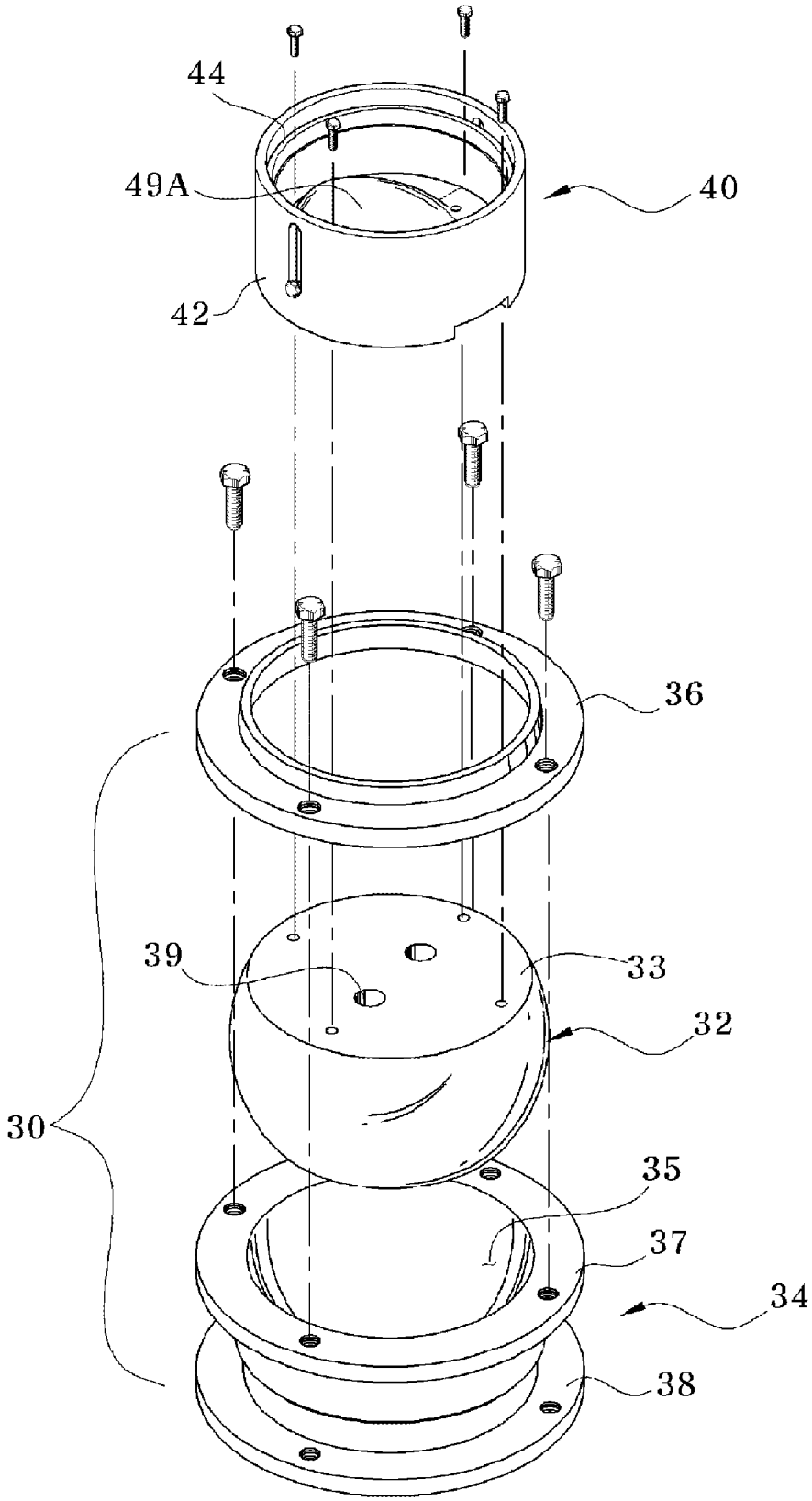
FIG. 10 is an exploded perspective view of a lighting direction adjuster and a lens moving means of the street lamp using LEDs according to a second embodiment of the present invention.
Figure 11:
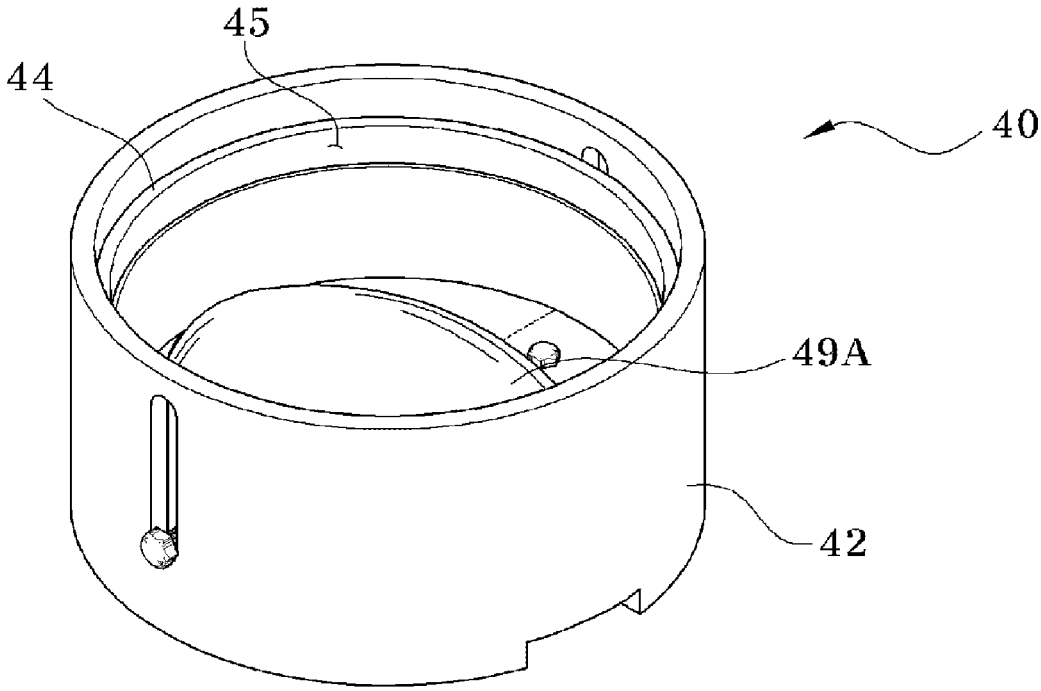
FIG. 11 is a perspective view of a lens case according to the second embodiment of the present invention.
Figure 12:
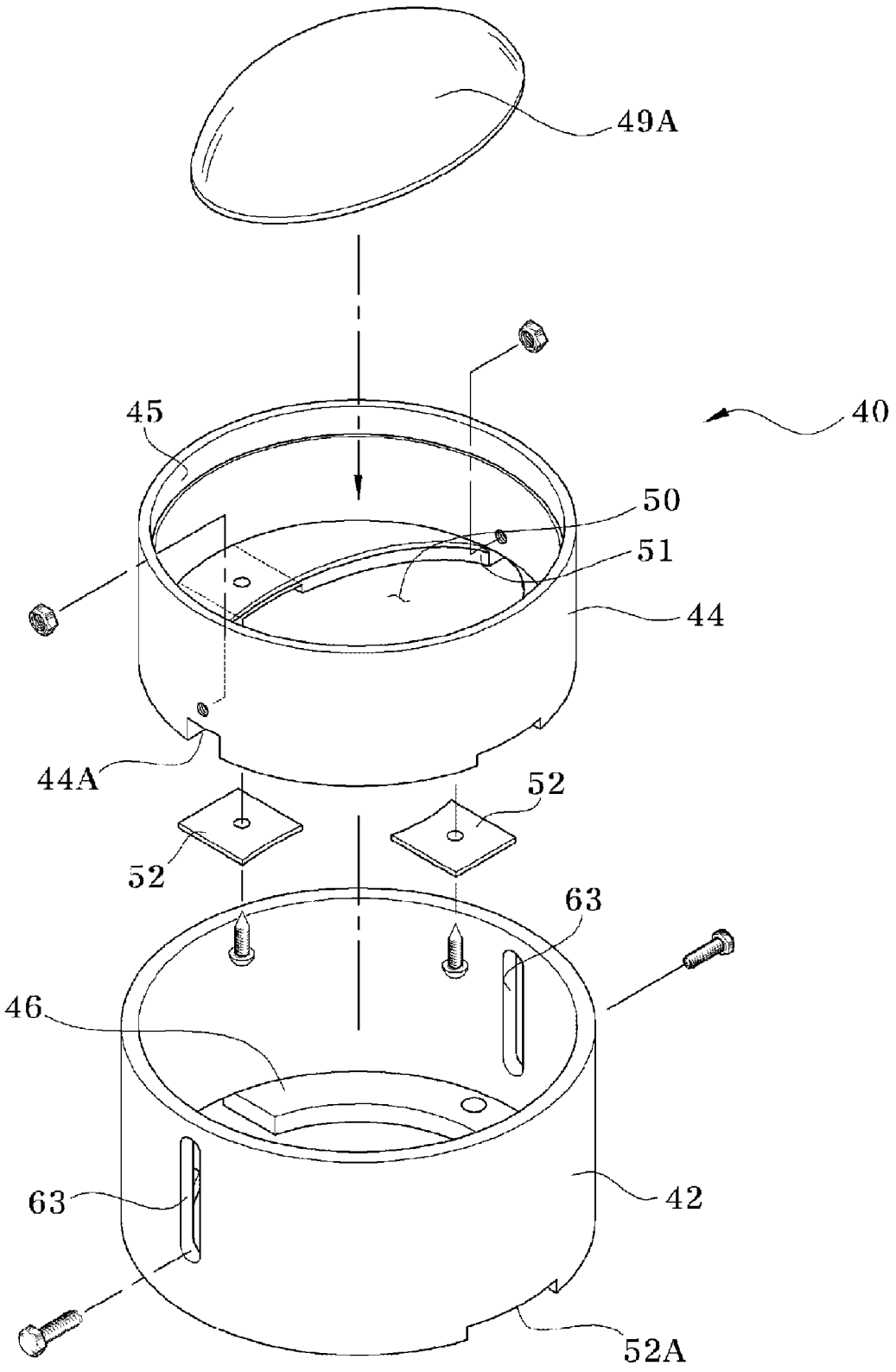
FIG. 12 is an exploded perspective view of FIG. 11

As shown in FIG. 10, the lighting direction adjuster 30 has the same construction as that in the first embodiment. That is, as shown in FIGS. 11 and 12, the lens case 40 includes the lower lens case 42 and the upper lens case 44, and the upper lens case 44 is inserted into the lower lens case 42.

Herein, the lower lens case 42 is formed into a cylindrical shape of which upper and lower sides are opened. A flange 46 is formed at a lower end of the lower lens case 42 so as to be radially protruded to an inside of the lower lens case 42. The flange 46 is formed with a bolt hole by which the lens case 40 can be fixed to the upper surface 33 of the spherical rotating body 32 using the bolt.

The upper lens case 44 is formed into a cylindrical shape of which upper and lower sides are opened. A hollow portion 50 is formed at a lower end of the lower lens case 42 so as to be radially protruded to an inside of the upper lens case 44 in the form of an elliptical shape for receiving an elliptical lens 49A. Therefore, the elliptical lens 49A is fixed to the lens case 44.

A recessed groove 51 corresponding to an edge shape of the elliptical lens 49A is formed at an edge side of the hollow portion 50 so that the elliptical lens 49A disposed at the hollow portion 50 is securely fixed to the upper lens case 44. When the elliptical lens 49A is disposed at the upper lens case 44, the elliptical lens 49A is inserted from a bottom surface of the upper lens case 44 so as to be caught by the recessed groove 51 of the hollow portion 50, and a lens fixing plate 52 for fixing an edge portion of the lens 49A is provided at a bottom surface of the upper lens case 44 and then securely fixed to the upper lens case 44 by a screw.

And a plurality of heat radiation holes 44A are formed at the lower ends of the upper and lower lens cases 44 and 42 so as to smoothly discharge heat generated from the LED 10.

In order to selectively illuminate the light emitted from the LED 10 onto a desired place without using of the reflecting plate 70, the second embodiment of the present invention uses the elliptical lens 49A.

Accordingly, the light emitted from the LED 10 is not diffused in the form of a circle, but irradiated along a long axis of the elliptical lens 49A, thereby preventing the light from being irradiated to the outside of a road or a sidewalk.

Figure 13:
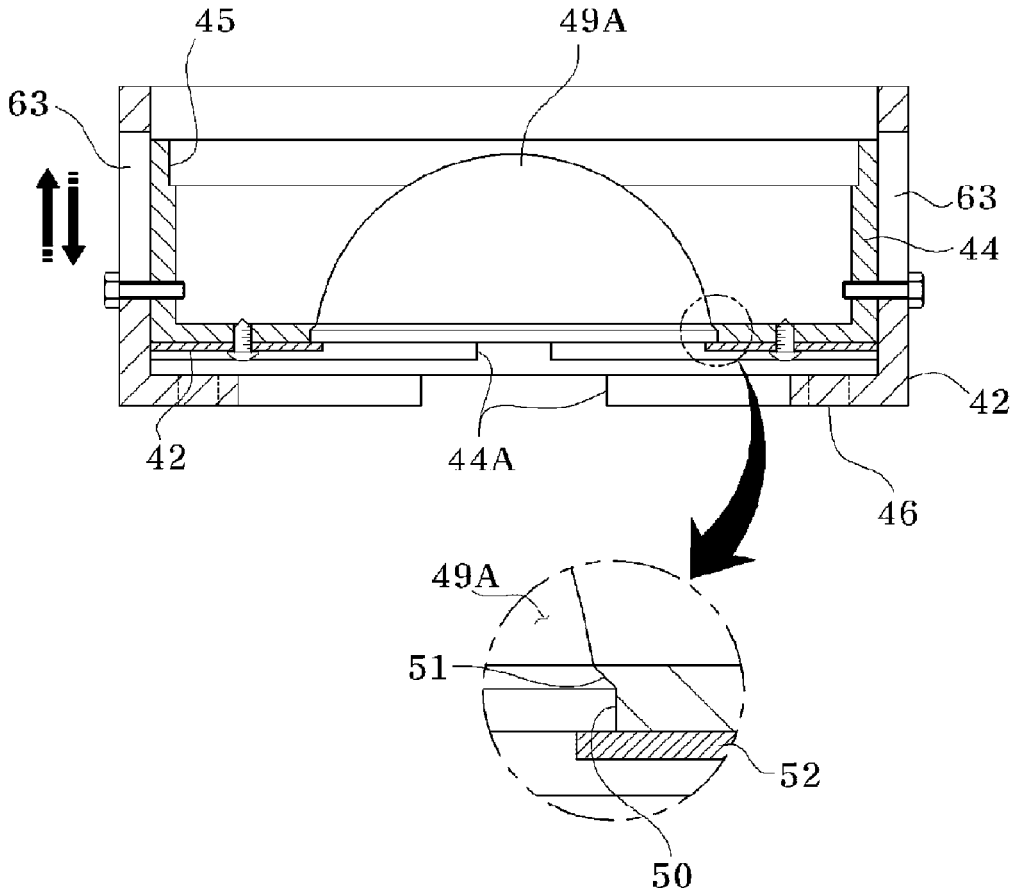
FIG. 13 is a cross-sectional view of the lens case of the street lamp using LEDs according to the second embodiment of the present invention.
Figure 14:
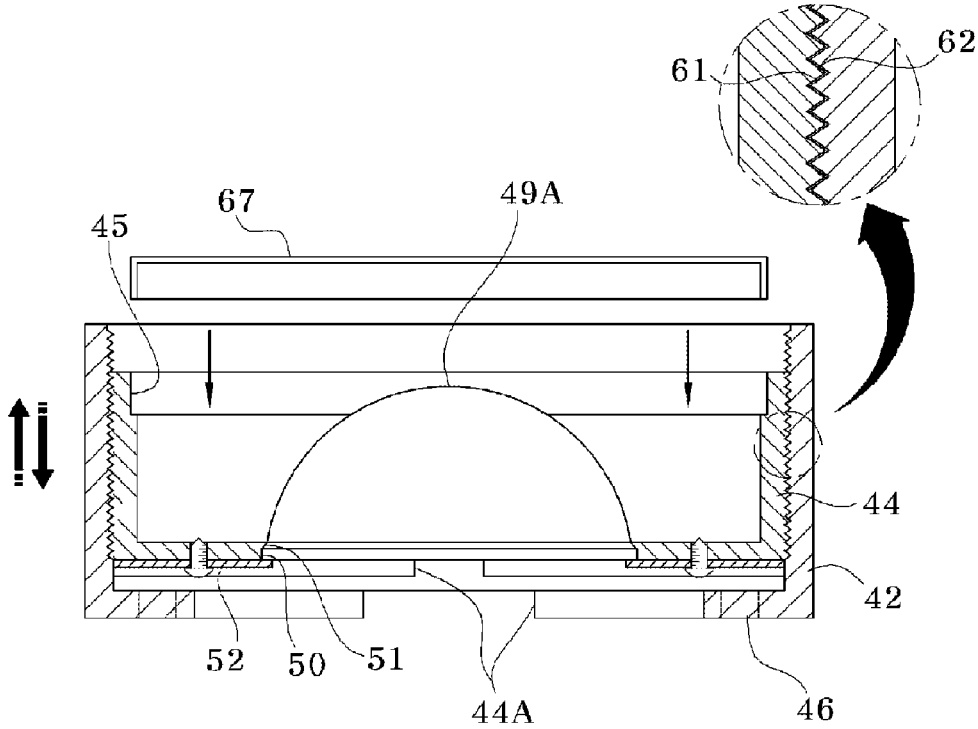
FIGS. 14 and 15 are cross-sectional views of the lens moving means of the street lamp using LEDs according to the second embodiment of the present invention.
Figure 15:
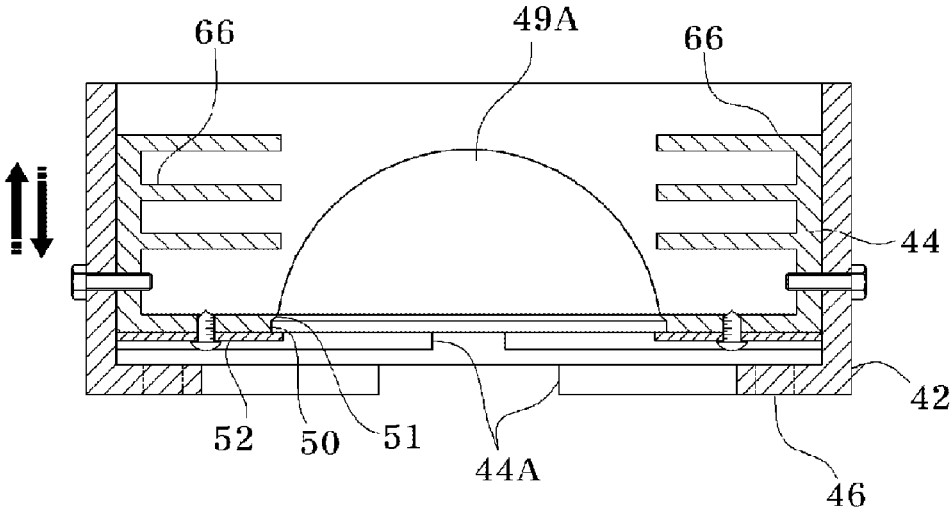

Further, the embodiment is also provided with the lens moving means. As shown in FIGS. 13 to 15, the lens moving means is embodied by using the same way as that in the first embodiment, such as the slot 63, the screw thread 61, 62 and the supporting protrusion 66.

Meanwhile, a step 45 for attaching a colored glass plate or a colored acrylic plate is formed at an upper inner circumferential surface of the upper lens case 44. By using the colored glass plate or the colored acrylic plate attached to the step 45, the light emitted from the LED 10 may have a desired color corresponding to the colored glass plate or the colored acrylic plate so as to be in harmony with the surrounding environment.

For example, in an area that the mist is often generated, a yellow glass plate is preferably used to provide the lighting from a distance. This is caused by that a light irradiation amount of a while LED is larger than that of a yellow LED.

Accordingly, the present invention can be used in various street lamps which are disposed at a certain place such as a sidewalk and a public square.

The street lamp of the present invention uses the LEDs as a light source and has the lighting direction adjuster including the spherical rotating body and the receiving body having a groove for receiving the spherical rotating body, thereby freely adjusting the lighting direction thereof.

Further, the street lamp of the present invention restricts the lighting range of the light emitted from the LEDs using the spherical rotating body so as to prevent the light from being illuminated onto the undesired place. Therefore, it is possible to illuminate the light onto the desired place such as a sidewalk and a footpath, thereby minimizing influences on the plants around the sidewalk and the footpath.

In addition, according to the present invention, the inclined surface is formed inside the housing, and the light emitting device is disposed on the inclined surface so that light emitted from the light emitting device is crossed to each other, and thus the light can be irradiated in the form of a rectangular shape having a longer side, whereby the light can be illuminated along a sidewalk or a footpath.

While the present invention has been described with respect to the specific embodiments, it will be apparent to those skilled in the art that various changes and modifications may be made without departing from the spirit and scope of the invention as defined in the following claims.

What is claimed is:

1. A street lamp using LEDs comprising:

a housing;

LED disposed in the housing;

a heat radiation fin formed on an upper surface of the housing;

a lighting direction adjuster disposed on a bottom surface of the heat radiation fin in the housing 1; and a lens case attached to an upper surface of the lighting direction adjuster and equipped with a lens moving means for positioning a lens disposed in the lens case, wherein the lighting direction adjuster comprises a spherical rotating body; a receiving body having a groove for receiving the spherical rotating body; and a cover plate disposed on the rotating body, wherein the lens case comprises an upper lens case and a lower lens case, and the upper lens case is inserted into the lower lens case, wherein a flange secured to the lighting direction adjuster is formed at a lower end of the lower lens case so as to be radially protruded to an inside of the lower lens case, wherein a hollow portion is formed at a lower end of the lower lens case so as to be radially protruded in the form of an elliptical shape to an inside of the upper lens case, wherein a recessed groove for receiving an elliptical lens is formed at an edge side of the hollow portion, and a lens fixing plate for fixing an edge portion of the lens is provided at a bottom surface of the hollow portion, and wherein a plurality of heat radiation holes are formed at the lower ends of the upper and lower lens cases so as to smoothly discharge heat generated from the LED.

2. The street lamp of claim 1, wherein the lens moving means comprises a screw thread is circumferentially formed on an inner surface of the lower lens case, and a screw thread is circumferentially formed on an outer surface of the upper lens case.

3. The street lamp of claim 1, wherein the lens moving means comprises a slot formed in a length direction of the lower lens case, a bolt hole formed at the upper lens case, and a bolt fastened to the bolt hole.

4. The street lamp of claim 1, wherein the lens moving means comprises a plurality of supporting protrusions formed at an inner surface of the upper lens case so as to be spaced apart at regular intervals in a length direction of the upper lens case.

5. The street lamp of claim 1, wherein a reflecting plate is disposed at one of sides of the lens case.

6. The street lamp of claim 1, wherein a pair of reflecting plates is disposed at both sides of the lens case so as to be opposite to each other.

7. The street lamp of claim 1, wherein a reflecting plate is disposed at one of sides of the lens case.

8. The street lamp of claim 1, wherein a pair of reflecting plates is disposed at both sides of the lens case so as to be opposite to each other.

* * * * *